United States Patent [19]

Hanson et al.

[11] Patent Number: 4,778,497

[45] Date of Patent: Oct. 18, 1988

[54] PROCESS TO PRODUCE LIQUID CRYOGEN

[75] Inventors: Thomas C. Hanson, Buffalo; Leslie C. Kun, Grand Island, both of N.Y.

[73] Assignee: Union Carbide Corporation, Danbury, Conn.

[21] Appl. No.: 56,702

[22] Filed: Jun. 2, 1987

[51] Int. Cl.[4] ..... F25J 3/00

[52] U.S. Cl. ..... 62/11; 62/38

[58] Field of Search ..... 62/9, 11, 23, 24, 25, 62/26, 29, 30, 36, 38, 41, 42, 43, 44

[56] References Cited

U.S. PATENT DOCUMENTS

| | | | |
|---|---|---|---|
| 3,144,316 | 8/1964 | Koehn et al. | 62/9 |
| 3,358,460 | 12/1967 | Smith et al. | 62/9 |
| 3,383,873 | 5/1968 | Becker | 62/11 |
| 3,677,019 | 7/1972 | Olszewski | 62/9 |
| 4,172,711 | 10/1979 | Bailey | 62/21 |
| 4,267,701 | 5/1981 | Toscano | 62/9 X |
| 4,334,902 | 6/1982 | Paradowski | 62/9 |
| 4,346,563 | 8/1982 | Hood | 62/38 X |
| 4,456,459 | 6/1984 | Brundige, Jr. | 62/9 |
| 4,560,398 | 12/1985 | Beddome et al. | 62/30 X |
| 4,582,519 | 4/1986 | Someya et al. | 62/38 X |
| 4,638,639 | 1/1987 | Marshall et al. | 62/9 |

*Primary Examiner*—Steven E. Warner

*Attorney, Agent, or Firm*—Stanley Ktorides

[57] ABSTRACT

A process to produce liquid cryogen wherein subcooled supercritical liquid is expanded without vaporization and a portion thereof is used to carry out the subcooling by vaporization under reduced pressure.

24 Claims, 2 Drawing Sheets

PROCESS TO PRODUCE LIQUID CRYOGEN

TECHNICAL FIELD

This invention relates to the liquefaction of gas to produce liquid cryogen and is an improvement whereby liquid cryogen is produced with increased efficiency.

BACKGROUND ART

An important method for the production of liquid cryogen, such as, for example, liquid nitrogen, comprises compression of gas, liquefaction, constant enthalpy expansion, and recovery. The constant enthalpy expansion, althouqh enabling the use of relatively inexpensive equipment, results in a thermodynamic inefficiency which increases energy costs.

It is an object of this invention to provide a liquefaction process which can operate with increased thermodynamic efficiency over heretofore available liquefaction processes.

SUMMARY OF THE INVENTION

The above and other objects, which will become apparent to one skilled in the art upon a reading of this disclosure, are attained by the present invention, one aspect of which is:

A process for the production of liquid cryogen comprising:

(A) compressing feed gas to a pressure at least equal to its critical pressure;

(B) cooling the compressed gas to produce cold supercritical fluid;

(C) subcooling the cold supercritical fluid to produce cold supercritical liquid;

(D) expanding the cold supercritical liquid to produce liquid cryogen essentially without formation of vapor;

(E) vaporizing a first portion of the expanded liquid cryogen by indirect heat exchange with subcooling cold supercritical fluid of step (C); and (F) recovering a second portion of liquid cryogen as product.

Another aspect of the process of this invention is:

A process for the production of liquid cryogen comprising:

(A) compressing feed gas to a pressure at least equal to its critical pressure;

(B) cooling the compressed gas to produce cold supercritical fluid;

(C) expanding the cold supercritical fluid to produce lower pressure fluid;

(D) cooling lower pressure fluid to produce liquid cryogen;

(E) vaporizing a first portion of the liquid cryogen by indirect heat exchange with the cooling lower pressure fluid of step (D); and (F) recovering a second portion of liquid cryogen as product.

As used herein, the "liquid cryogen" means a substance which at normal pressures is liquid at a temperature below 200° K.

As used herein, the term "critical pressure" means the pressure above which there is no distinguishable difference between vapor and liquid phase at any temperature.

As used herein, the term "subcooling" means cooling below the critical temperature for a supercritical fluid and cooling to below the bubble point temperature for a subcritical liquid.

As used herein, the term "supercritical" means above the critical pressure of the substance.

As used herein, the term "turbine" means a device which extracts shaft work from a fluid by virtue of expansion to a lower pressure.

As used herein, the term "indirect heat exchange" means the bringing of two fluid streams into heat exchange relation without any physical contact or intermixing of the fluids with each other.

DETAILED DESCRIPTION

The invention will be described in detail with reference to the Drawings.

Figure 1:
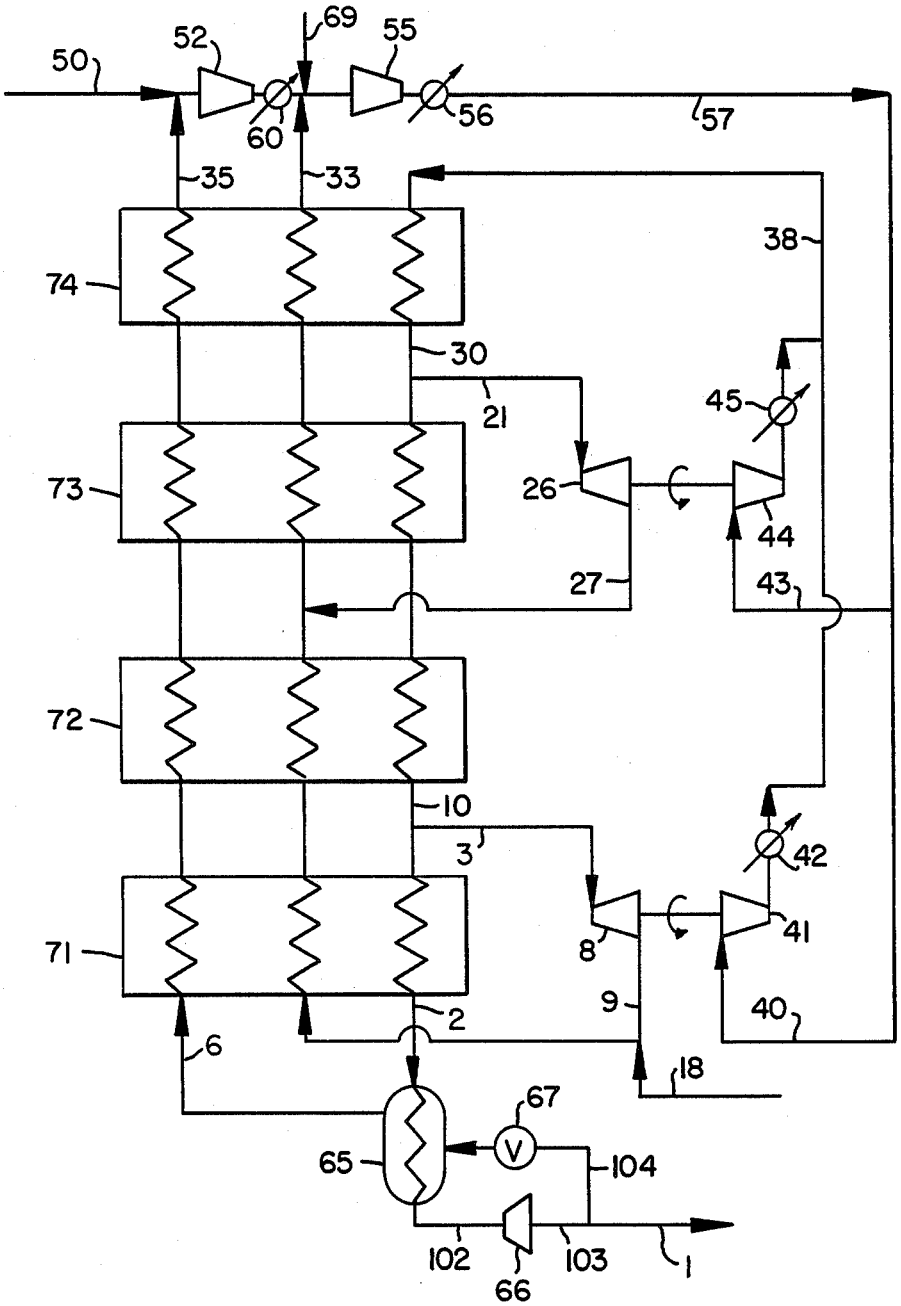
FIG. 1 is a schematic representation of one preferred embodiment of the process of this invention.

Referring now to FIG. 1, feed gas 50 is compressed through compressor 52, cooled by aftercooler 60, further compressed by compressor 55 and cooled by aftercooler 56 to produce intermediate pressure gas stream 57. Aftercoolers 60 and 56 serve to remove heat of compression.

The feed gas may be any gas which upon liquefaction can produce a liquid cryogen. Examples include helium, hydrogen, all the common atmospheric gases such as nitrogen, oxygen and argon, many hydrocarbon gases such as methane and ethane, and mixtures of these gases such as air and natural qas.

Intermediate pressure gas stream 57 is then compressed to a pressure equal to or greater than its critical pressure. The critical pressure for nitrogen, for example, is 493 psia.

FIG. 1 illustrates a preferred embodiment wherein gas stream 57 is divided into two portions 43 and 40, compressed through compressors 44 and 41 respectively, cooled by aftercoolers 45 and 42 respectively, and then recombined to form high pressure gas stream 38. Stream 43 may be from 0 to 50 percent of stream 40. Stream 38 will generally have a pressure within the range of from 500 to 1500 psia, preferably within the range of from 600 to 750 psia, when the gas is nitrogen.

Compressed gas 38 is then cooled to produce cold supercritical fluid 2. In the embodiment illustrated in FIG. 1 compressed gas 38 is cooled by passage through a heat exchanger having four legs labelled 74, 73, 72, 71. Stream 30 emerges from first leg 74 and a portion 21 is passed to expander 26 which is in power relation with compressor 44. Portion 21 may be from 5 to 30 percent of stream 30. In this way compressor 44 is driven by cooled compressed gas.

Stream 30 is further cooled by passage through second leg 73 and third leg 72 to produce further cooled high pressure fluid 10. A portion 3 of fluid 10 is passed to expander 8 which is in power relation with compressor 41. Portion 3 may be from 50 to 90 percent of stream 10. In this way compressor 41 is driven by further cooled high pressure fluid.

Stream 10 is then further cooled by passage through fourth leg 71 to produce cold supercritical fluid 2.

Fluid 2 is subcooled by passage through flashpot 65 to produce cold supercritical liquid 102. Liquid 102 is expanded through expansion device 66 to produce lower pressure liquid cryogen 103, at a pressure generally within the range of from 30 to 750 psia. The expansion device may be any device suitable for expanding a liquid such as a turbine, a positive displacement expander, e.g., a piston, and the like. Essentially none of liquid 102 is vaporized by the expansion. Preferably the expansion is a turbine expansion. First portion 104 of liquid cryogen 103 is throttled through valve 67 to flashpot 65 and is vaporized, at a pressure generally within the range of from 12 to 25 psia, by indirect heat exchange with subcooling fluid 2. First portion 104 is from 5 to 20 percent of liquid 103. Second portion 1 of liquid cryogen 103 is recovered as product liquid cryogen generally at a pressure within the range of from 30 to 750 psia.

The embodiment illustrated in FIG. 1 is a preferred embodiment wherein certain streams are employed to cool compressed gas to produce the cold supercritical fluid.

Referring again to FIG. 1 vaporized first portion 6 from flashpot 65 is passed through all four heat exchanger legs serving to cool by indirect heat exchange compressed gas to produce cold supercritical fluid. The resulting warm stream 35 which emerges from first leg 74 is passed to feed gas stream 50 and recycled through the process. Preferably the vaporized portion from the flashpot is compressed prior to its being passed to the feed gas stream. In this way the vaporized portion from the flashpot could be at a lower pressure level and thereby allow for a lower temperature in the flashpot. When the vaporized portion from the flashpot is so compressed, it is particularly preferred that the compressor means be powered by shaft energy from the expansion device which expands the cold supercritical liquid.

Outputs 27 and 9 from expanders 26 and 8 respectively are also passed through the heat exchanger legs thus serving to cool by indirect heat exchange compressed gas to produce cold supercritical fluid. Output 9 is passed through all four heat exchanger legs while output 27 is passed through only the first and second legs. Preferably the output streams are combined and combined warm stream 33 is passed to compressed feed gas stream 50 and recycled through the process. Thus, in the embodiment illustrated in FIG. 1, stream 57 contains both recycled vaporized first portion and recycled expander output.

A preferred arrangement which can be used when the feed gas is from a cryogenic air separation plant is the addition of warm shelf vapor 69 to the feed gas and/or the addition of cold shelf vapor 18 to expander output 9 upstream of passage through the heat exchanger legs.

Figure 2:
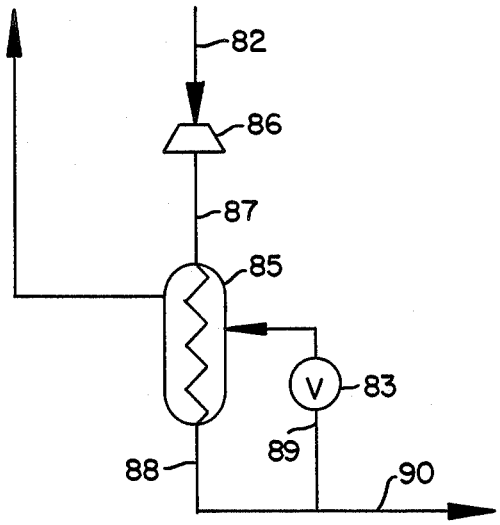
FIG. 2 is a schematic representation of an alternative embodiment of the process of this invention.

FIG. 2 illustrates another embodiment of the process of this invention wherein the order of the flashpot and turbine is reversed. Since all other aspects of the embodiment illustrated in FIG. 2 can be the same as those of the embodiment illustrated in FIG. 1, only the parts which differ from FIG. 1 are shown in FIG. 2.

Referring now to FIG. 2, cold supercritical fluid 82 is expanded through expansion device 86 to produce lower pressure fluid 87 having a pressure generally within the range of from 90 to 750 psia. Fluid 87 is passed to flashpot 85 wherein it is cooled to produce liquid cryogen 88. First portion 89 of liquid cryogen 88 is throttled through valve 83 and is vaporized in flashpot 85, at a pressure generally within the range of from 12 to 25 psia, so as to cool by indirect heat exchange lower pressure fluid to produce liquid cryogen. Second portion 90 of liquid cryogen 88 is recovered as product.

Table 1 is a tabulation of a computer simulation of the process of this invention carried out in accordance with the embodiment illustrated in FIG. 1. The stream numbers refer to those of FIG. 1. The abbreviation cfh refers to cubic feet per hour at standard conditions, psia to pounds per square inch absolute, and K to degrees Kelvin.

TABLE 1

| Stream No. | Flow, cfh | Pressure, psia | Temperature, K. |
|---|---|---|---|
| 1 | 100000 | 120.0 | 79.7 |
| 2 | 116110 | 700.6 | 93.9 |
| 6 | 16110 | 18.6 | 79.5 |
| 3 | 327856 | 698.0 | 176.7 |
| 9 | 327856 | 67.6 | 93.1 |
| 21 | 123126 | 701.1 | 294.2 |
| 27 | 123126 | 66.4 | 164.9 |
| 38 | 567091 | 709.0 | 296.2 |
| 33 | 450982 | 62.6 | 297.3 |
| 35 | 16110 | 16.0 | 297.3 |
| 102 | 116107 | 700.6 | 80.5 |
| 103 | 116107 | 30.0 | 79.9 |
| 104 | 16110 | 30.0 | 79.9 |
| 50 | 113340 | 15.0 | 295.0 |
| 57 | 568220 | 429.3 | 299.8 |

For comparative purposes a calculated example of the process of this invention carried out in accordance with the embodiment of FIG. 1 (Column A) is compared to a calculated example of a conventional liquefaction process which does not recycle a portion of the product through a flashpot for subcooling (Column B). Flow is reported in thousands of cubic feet per hour at standard conditions.

| | A | B |
|---|---|---|
| Feed Gas Inlet Flow | 131.3 | 132.5 |
| Feed Gas Pressure Ratio | 4.3 | 4.3 |
| Recycle Inlet Flow | 594.8 | 633.6 |
| Recycle Pressure Ratio | 6.9 | 6.8 |
| Gross Liquid Production | 119.2 | 119.6 |
| Recycled Portion | 16.7 | — |
| Gross Product Liquid | 102.5 | 119.6 |
| Net Product Liquid | 100 | 100 |
| Liquid Flashoff Loss | 2.5 | 19.6 |
| Normalized Liquefaction Power | 100 | 104 |

As can be seen from the calculated comparative example, the process of this invention, due to reduced product liquid flashpot losses, exhibits a 4 percent increase in overall efficiency over the conventional liquefaction process. The result is surprising and could not have been predicted.

Now by the process of this invention, one can liquefy a gas stream to produce a liquid cryogen while recovering the thermodynamic energy, heretofore lost, in the expansion of the liquid cryogen to ambient pressure. This results in an improved overall process efficiency over heretofore known liquefaction methods. Moreover, the process efficiency is attained despite the recycle of a portion of the liquid cryogen back to the flashpot.

Although the process of this invention has been described with reference to certain embodiments, those skilled in the art will recognize that there are other embodiments of the invention within the spirit and scope of the claims.

We claim:

1. A process for the production of liquid cryogen comprising:

(A) compressing feed gas to a pressure at least equal to its critical pressure;
(B) cooling the compressed gas to produce cold supercritical fluid;
(C) subcooling the cold supercritical fluid to produce cold supercritical liquid;
(D) expanding the cold supercritical liquid to produce liquid cryogen essentially without formation of vapor land thereafter further expanding a first portion of the expanded liquid cryogen to a lower pressure;
(E) vaporizing said further expanded first portion by indirect heat exchange with subcooling cold supercritical fluid of step (C); and
(F) recovering the remaining second portion of liquid cryogen as liquid product.

2. The process of claim 1 wherein the first portion comprises from 5 to 20 percent of the liquid cryogen.

3. The process of claim 1 wherein the feed gas is nitrogen.

4. The process of claim 1 wherein the feed gas is taken from a cryogenic air separation plant.

5. The process of claim 1 wherein the vaporized first portion is warmed by indirect heat exchange against cooling compressed gas of step (B).

6. The process of claim 5 wherein the warmed first portion is combined with feed gas and recycled through the process.

7. The process of claim 6 wherein the warmed first portion is compressed, prior to combination with feed gas, by compressor means powered by the expansion of step (D).

8. The process of claim 1 wherein the feed gas is compressed by compressor means powered by expansion of some of the compressed gas through expander means.

9. The process of claim 8 wherein feed gas in divided into two portions, each portion separately compressed by separate compressor means powered by expansion of some of the compressed gas through expander means, and the compressd portions recombined prior to the cooling of step (B).

10. The process of claim 8 wherein output from the expander means is warmed by indirect heat exchange against cooling compressed gas of step (B).

11. The process of claim 10 wherein the warmed expander means output is combined with feed gas and recycled through the process.

12. A process for the production of liquid cryogen comprising:
(A) compressing feed gas to a pressure at least equal to its critical pressure;
(B) cooling the compressed gas to produce cold supercritical fluid;
(C) expanding the cold supercritical fluid to produce lower pressure fluid;
(D) cooling lower pressure fluid to produce liquid cryogen and thereafter expanding a first portion of the liquid cryogen to a lower pressure;
(E) vaporizing said expanded first portion by indirect heat exchange with the cooling lower pressure fluid of step (D); and
(F) recovering the remaining second portion of liquid cryogen as liquid product.

13. The process of claim 12 wherein the first portion comprises from 5 to 20 percent of the liquid cryogen.

14. The process of claim 12 wherein the feed gas is nitrogen.

15. The process of claim 12 wherein the feed gas is taken from a cryogenic air separation plant.

16. The process of claim 12 wherein the vaporized first portion is warmed by indirect heat exchange against cooling compressed gas of step (B).

17. The process of claim 16 wherein the warmed first portion is combined with feed gas and recycled through the process.

18. The process of claim 17 wherein the warmed first portion is compressed, prior to combination with feed gas, by compressor means powered by the expansion of step (C).

19. The process of claim 12 wherein feed gas is compressed by compressor means powered by expansion of some of the compressed gas through expander means.

20. The process of claim 19 wherein feed gas is divided into two portions, each portion separately compressed by separate compressor means powered by expansion of some of the compressed gas through expander means, and the compressed portions recombined prior to the cooling of step (B).

21. The process of claim 19 wherein output from the expander means is warmed by indirect heat exchange against cooling compressed gas of step (B).

22. The process of claim 21 wherein the warmed expander means output is combined with feed gas and recycled through the process.

23. A process for the production of liquid cryogen comprising:
(A) dividing feed gas into two portions, compressing each portion separately to a pressure at least equal to its critical pressure by separate compressor means powered by expansion of some of the compressed gas through expander means, and recombining the compressed portions to form compressed gas;
(B) cooling the compressed gas to produce cold supercritical fluid;
(C) subcooling the cold supercritical fluid to produce cold supercritical liquid;
(D) expanding the cold supercritical liquid to produce liquid cryogen essentially without formation of vapor;
(E) vaporizing a first portion of the expanded liquid cryogen by indirect heat exchange with subcooling cold supercritical fluid of step (C); and
(F) recovering a second portion of liquid cryogen as product.

24. A process for the production of liquid cryogen comprising:
(A) dividing feed gas into two portions, compressing each portion separately to a pressure at least equal to its critical pressure by separate compressor means powered by expansion of some of the compressed gas through expander means, and recombining the compressed portions to form compressd gas;
(B) cooling the compressed gas to produce cold supercritical fluid;
(C) expanding the cold supercritical fluid to produce lower pressure fluid;
(D) cooling lower pressure fluid to produce liquid cryogen;
(E) vaporizing a first portion of the liquid cryogen by indirect heat exchange with the cooling lower pressure fluid of step (D); and
(F) recovering a second portion of liquid cryogen as product.

* * * * *